US005836859A

United States Patent [19]

Van Herle

[11] Patent Number: 5,836,859

[45] Date of Patent: Nov. 17, 1998

[54] FULL BODY EXERCISE MACHINE

[76] Inventor: Philippe Johan Van Herle, 10706 Lindbrook Dr., Los Angeles, Calif. 90024

[21] Appl. No.: 873,616

[22] Filed: Jun. 12, 1997

[51] Int. Cl.[6] ..... A63B 21/008

[52] U.S. Cl. ..... 482/112; 482/137; 482/138

[58] Field of Search ..... 482/111, 112, 482/133, 134, 135, 138, 130, 129, 137

[56] References Cited

U.S. PATENT DOCUMENTS

| | | | |
|---|---|---|---|
| 4,275,882 | 6/1981 | Grosser et al. | 482/112 |
| 4,326,707 | 4/1982 | Strecker . | |
| 4,759,539 | 7/1988 | Nieppola . | |
| 4,805,901 | 2/1989 | Kulick . | |
| 4,928,957 | 5/1990 | Lanier et al. . | |
| 4,979,736 | 12/1990 | Maynard . | |
| 5,320,591 | 6/1994 | Harmon et al. . | |

*Primary Examiner*—Lynne A. Reichard

[57] ABSTRACT

An exercise machine for strengthening of the muscles of the upper body, abdomen, and legs has a damper (68), pivotally mounted on its first end to the first end of a bench (10) and pivotally connected by its second end to a T-shaped bar (20) to which the user shall exercise the upper body muscles by alternately applying a pushing and pulling force. Another damper (70) is pivotally mounted on its first end to the second end of the bench, its second end being pivotally connected to a U-shaped lever (22). The first ends of the U-shaped lever are pivotally mounted near the second end of the bench, a padded bar (32) is mounted near the upper end of the U-shaped lever, and the second end of the U-shaped lever is mounted to a hinge (30). The hinge is pivotally mounted to a lever (24) by said first end which is in turn connected by its second end to a length adjusting bar (26) having a foot rest (28) mounted to its free end. The user will exercise the legs by applying a pushing force to the foot rest. Abdominal muscles shall be exercised when the user applies a pulling force to the padded bar with the frontal portion of their thighs.

23 Claims, 11 Drawing Sheets

FULL BODY EXERCISE MACHINE

BACKGROUND

1. Field of Invention

Figure 1:
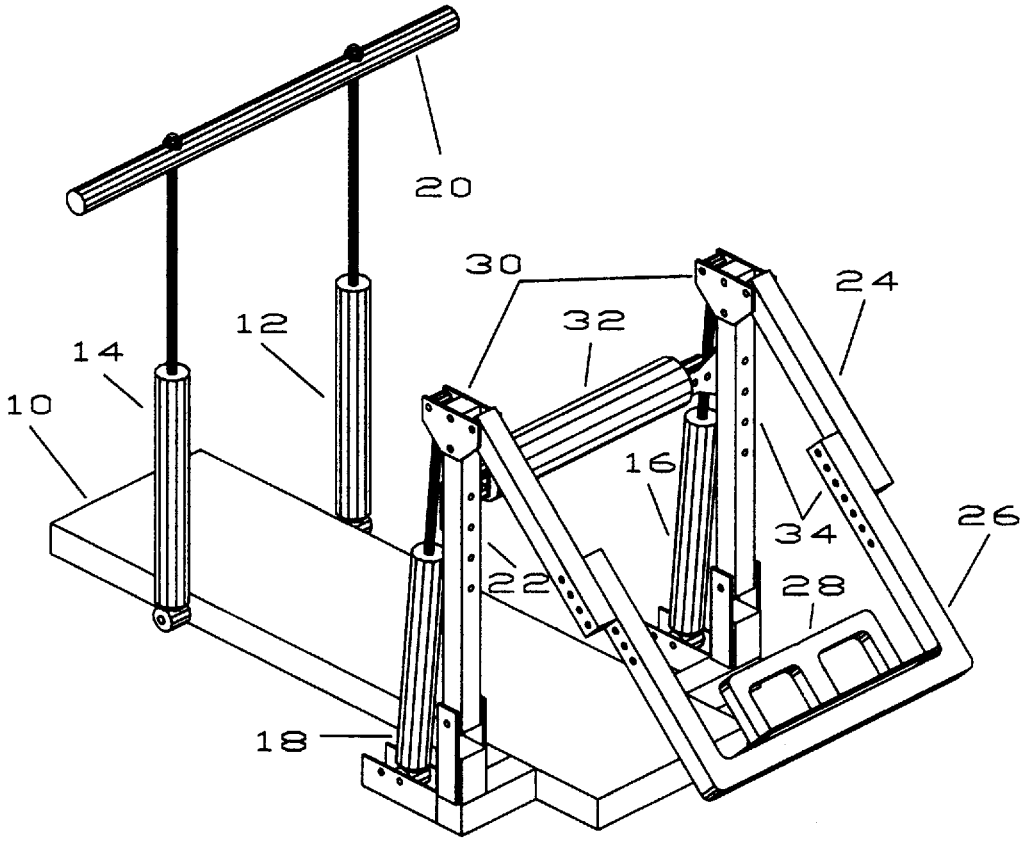

This invention relates to full body exercise machines, specifically to those which utilize hydraulic resistance and provide a single routine full body workout.

BACKGROUND

2. Description of Prior Art

Fitness equipment manufactures have recently flooded the market with home exercise machines that are intended to provide consumers with a complete full body workout.

Most of these manufacturers hoped to meet the four following goals when they created their machines:

(i) A machine that provided a complete full body workout.

(ii) A machine that provides resistance sufficient enough to build muscle strength and mass.

(iii) A machine that provided a quick workout.

(iv) A machine that was compact enough for home use.

Some of the major manufacturers that attempted to meet these goals include Trimax, Soloflex and Nordic Track to name a few. All of these manufacturers build similar machines in terms of function although their methods of providing resistance may vary.

The problem with all of these machines is that they only meet one requirement, they only provide a complete full body workout. They failed at producing a compact machine as all of these machines take up a majority of space in any room. They fail at providing a quick workout because a complete workout on any of these machines requires several body position changes and sometimes even mechanical adjustments. And many of these machines fail at providing sufficient workout resistance.

The Trimax machine should be briefly discussed because it's method for providing resistance is similar to that of the resistance provided in the invention being discussed. Trimax offers a workout machine on the market that utilizes hydraulic dampers for resistance but it does not have the same characteristics of the invention being discussed because it requires that the user perform several different routines to get a full body workout, whereas the invention at hand offers the user a single simultaneous full body workout. The Trimax machine also fails to provide adjustable resistance dampers and it is not a small, compact machine that is simple to manufacture and store away. The Trimax machine cannot provide the user with workout information or provide the user with a computer monitored and controlled workout. The main benefit of the computer monitored and controlled exercise machine is that the user can workout at his maximum strength level.

A patent search revealed that there were some exercise machines that were similar to the machine being disclosed in this application, on the basis of method of resistance or compactness or ease of use and they will be discussed here to prove that they do not destroy the novelty and uniqueness of the invention described in this application. U.S. Pat. Nos. 5,320,591 Harmon and Esty (1993); 4,979,736 Maynard (1989) and 4,326,707 Strecker (1979) are similar to the invention on the basis of method of resistance because they utilize hydraulic resistance. U.S. Pat. Nos. 4,805,901 Kulick (1987) and 4,759,539 Nieppola (1986) are similar to the invention discussed in that they can fold up for easy storage. U.S. Pat. No. 4,928,957 Lanier et. al. (1988) is similar to the invention being discussed in that it provides for a workout that exercises the upper and lower body simultaneously although it states that it only provides a passive lower body workout. Although each on of these patents may have one characteristic of the invention being discussed in this application they do not cancel out the uniqueness of this invention in that none of the single patents cited contains all of the unique characteristics of the invention discussed herein in any combination. Furthermore one should note that the machine discussed in this application contains more unique characteristics than just those which can be found in the cited patents and overall it is believed to be superior to the cited as well as other exercise machines. Most exercise machines up until the one cited in this application suffer from some the following problems:

(a) They require a fair amount of time to use because in order to achieve a full body workout the user must change their position and/or make complicated adjustments to the machine which takes time and interrupts the workout.

(b) They require a fair amount of space and cannot be stored away because they don't fold up. Most of these machines would not be useful in an apartment or even a house because they take up so much space.

(c) They only provide for resistance in one direction. That is that they don't provide a push/pull resistance that is required for complete muscle development.

(d) These machines do not provide for completely adjustable resistance. Most often they provide for incremental changes in resistance which requires that the user must wait longer periods to start exercising at a higher resistance level.

(e) These machines are very expensive due to the great number and complexity of parts.

(f) These machine are not capable of providing a computer monitored and adjusted resistance level that keeps the user at their peak resistance or aerobic level.

For the aforementioned reasons and from conclusions reached in an initial patent search I do believe that no other exercise machine exists, is similar to or has the same attributes of the newly invented exercise machine being discussed in this documentation.

OBJECTS AND ADVANTAGES

The objects and advantages of the invention disclosed in this application are:

(a) This exercise machine provides the user with a quick and easy workout routine that exercises all the major muscle groups of the arms, chest, back, abdomen and leg simultaneously therefore effectively cutting down on workout time.

(b) The machine is compact and folds up so that it can be stored away when not being used.

(c) It provides for push/pull resistance so that it will give muscles a complete workout.

(d) The resistance is fully adjustable so that the user can stay at their exact strength level and they can adjust the resistance to create either a muscle building or aerobic workout.

(e) Due to the simplicity of its design it would be inexpensive to produce.

(f) The computer monitored and adjustable resistance capability of this machine allows the user to remain at their maximum strength or maximum aerobic level without having to make adjustments.

Further objects and advantages will become apparent from the ensuing description and drawings.

DRAWING FIGURES

FIG. 1: This figure shows an axonometric view of the exercise machine which has been prototyped.

Figure 2:
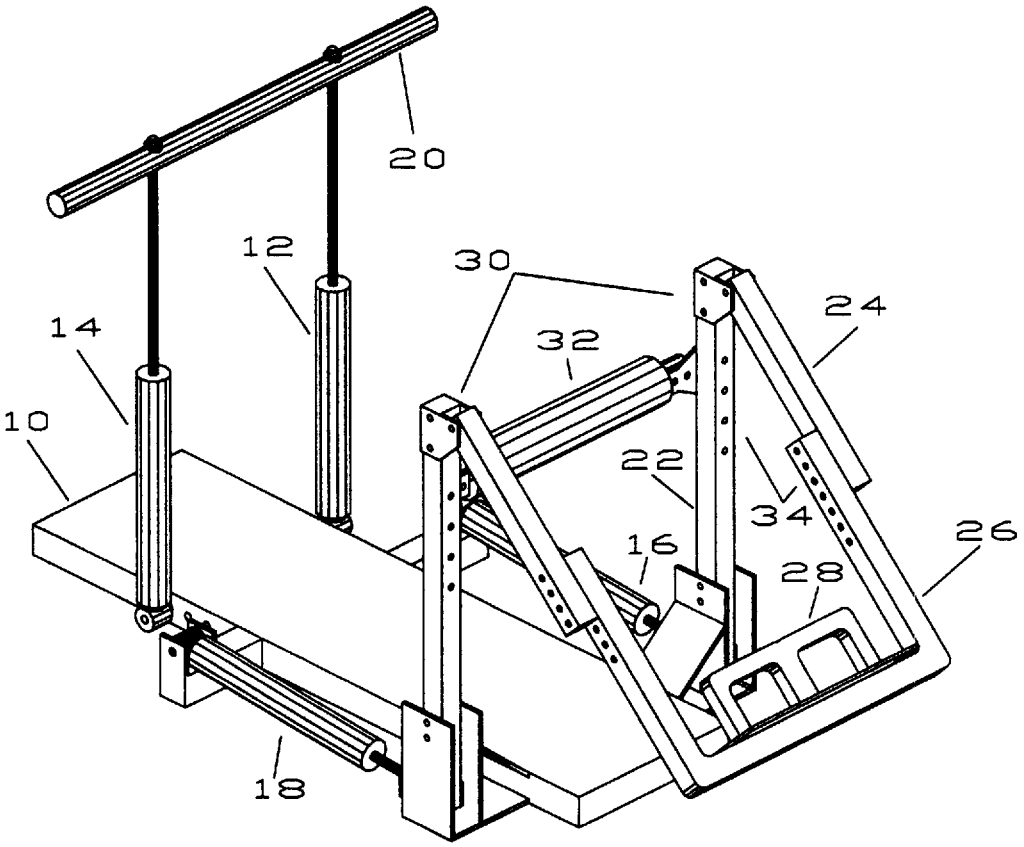

FIG. 2: This figure shows a version of the invention very similar to that which was prototyped the only difference being that the leg dampers were mounted along the length of the workout bench instead of being mounted along the length of the upper leg press bar as they are in FIG. 1.

Figure 3:
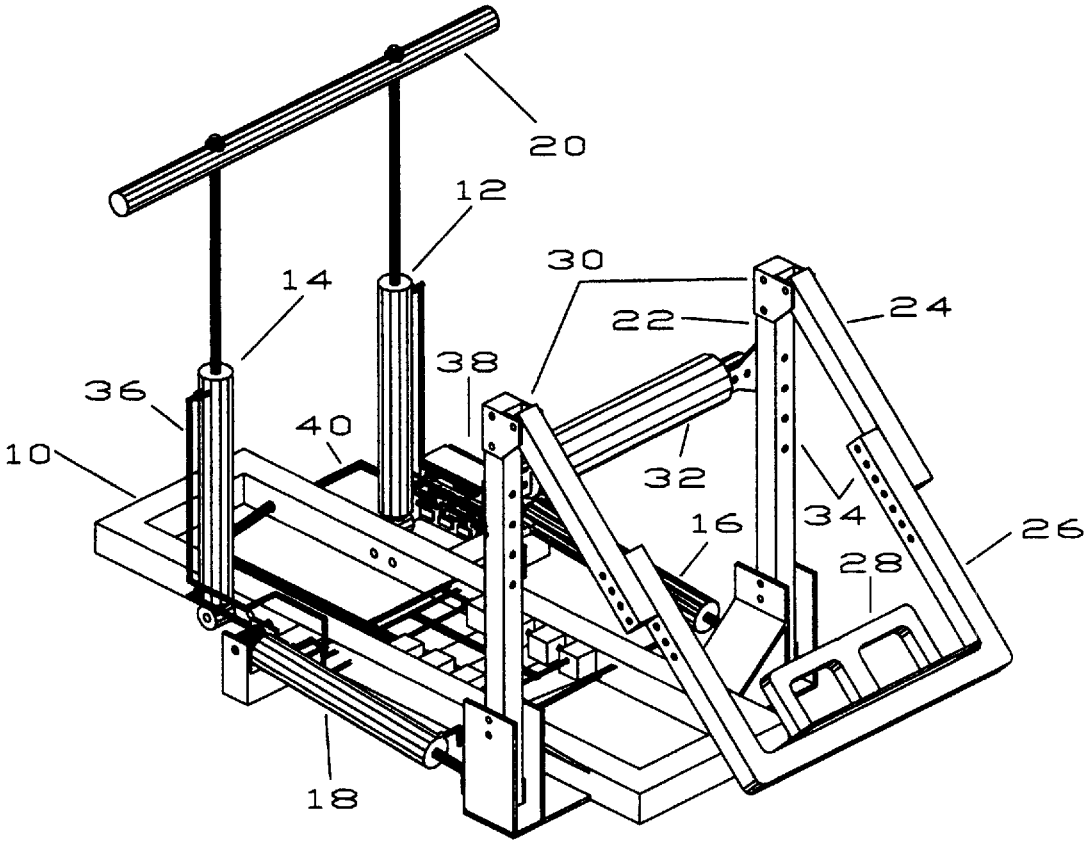

FIG. 3: This figure shows the computer monitored and controlled exercise machine.

Figure 3A:
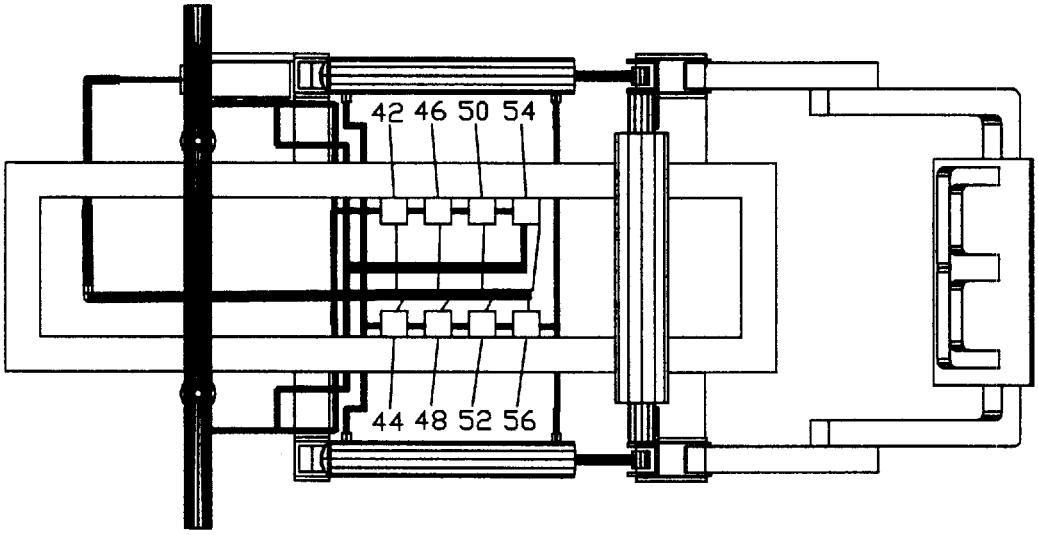

FIG. 3A: This figure shows a close-up of how the various sensors and solenoids could be laid out on the inside rail of the bench frame.

Figure 4:
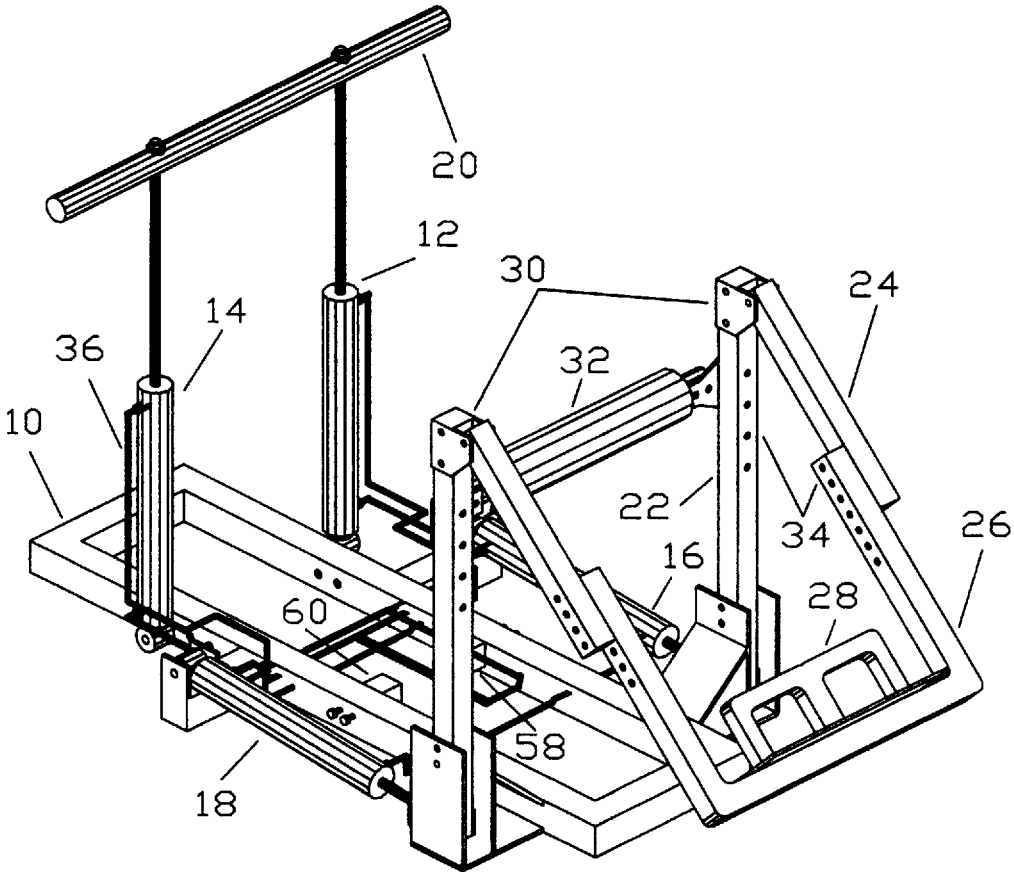

FIG. 4: This figure shows a model which has manually adjusted dampers, where the damper adjusters are mounted to the bench frame.

Figure 5:
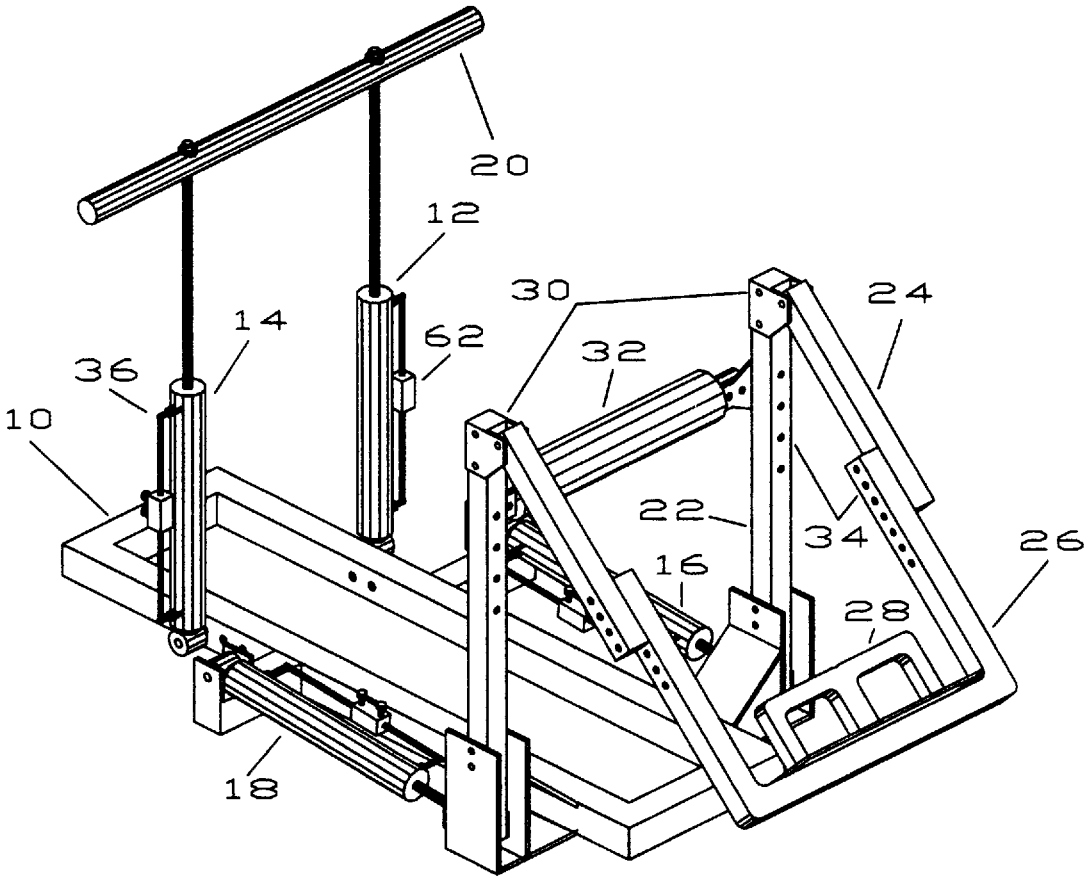

FIG. 5: This figure shows an exercise machine with manually adjusted dampers, where the damper adjusters are mounted inline with hydraulic tubing mounted directly to the dampers.

Figure 6:
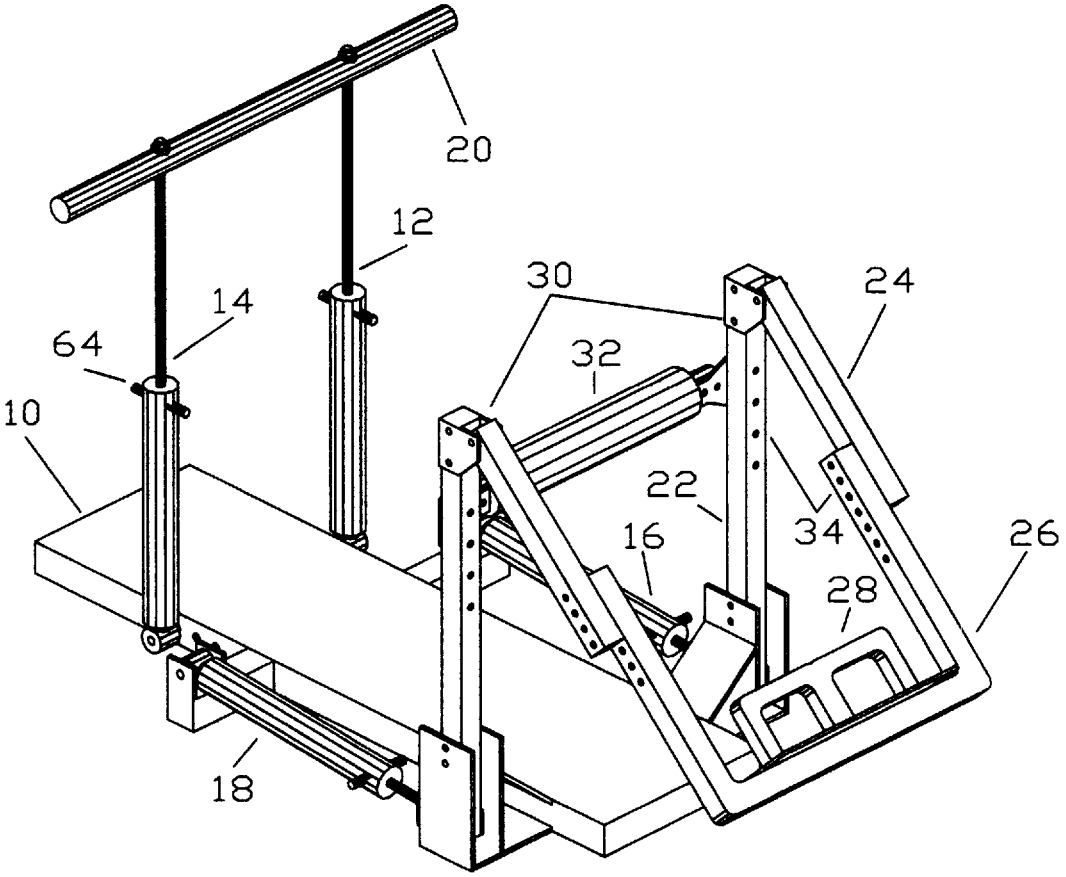

FIG. 6: This is a drawing of an exercise machine that uses pneumatic dampers to supply resistance.

Figure 7:
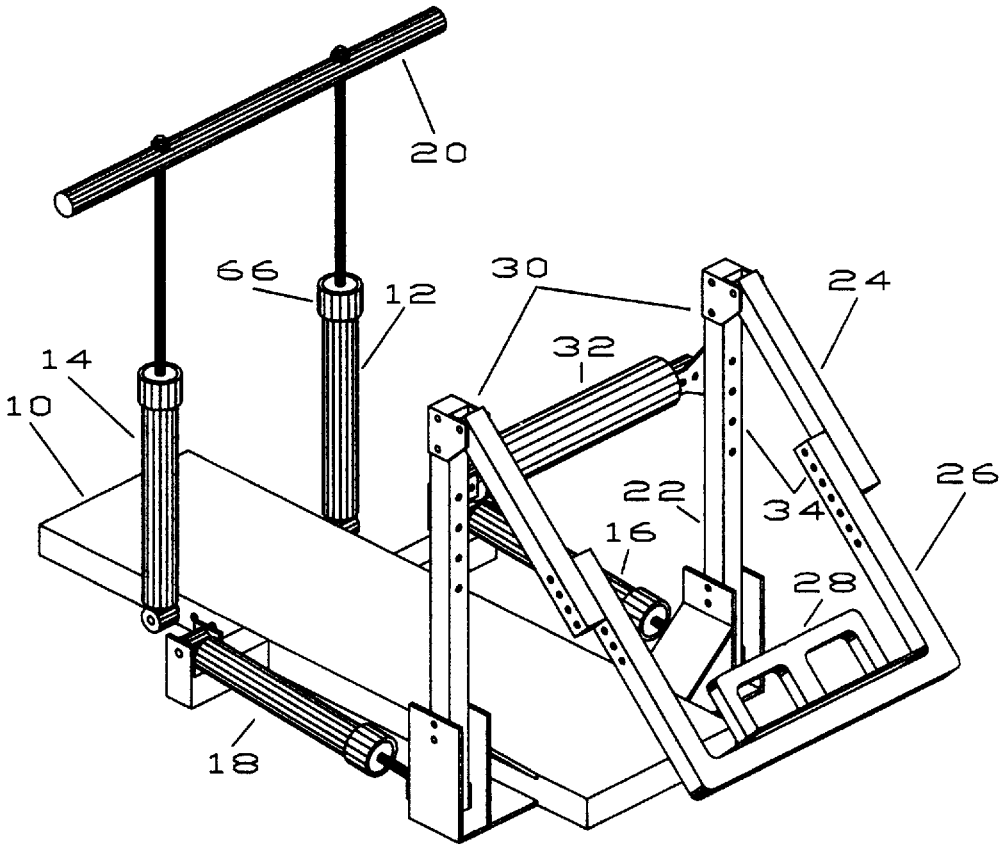

FIG. 7: This is a drawing of an exercise machine that uses dial adjusted resistance dampers.

Figure 8:
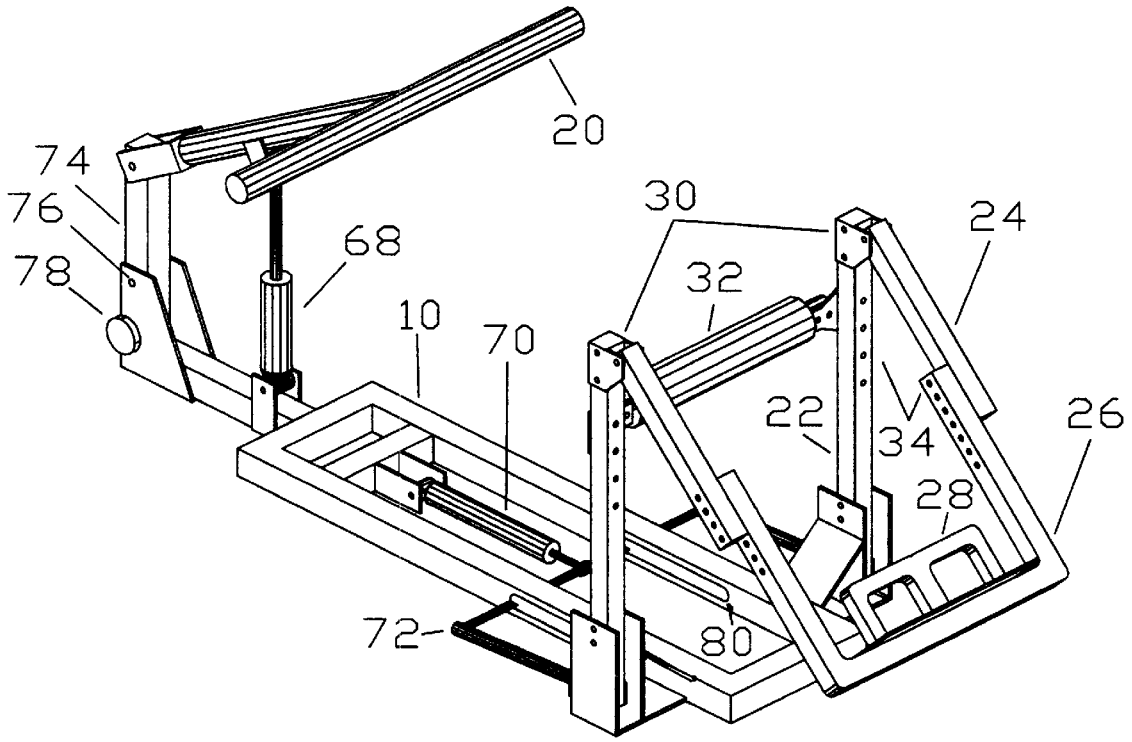

FIG. 8: This version differs from the previous seven in that this machine requires only two dampers to supply all the resistance in the system.

Figure 9:
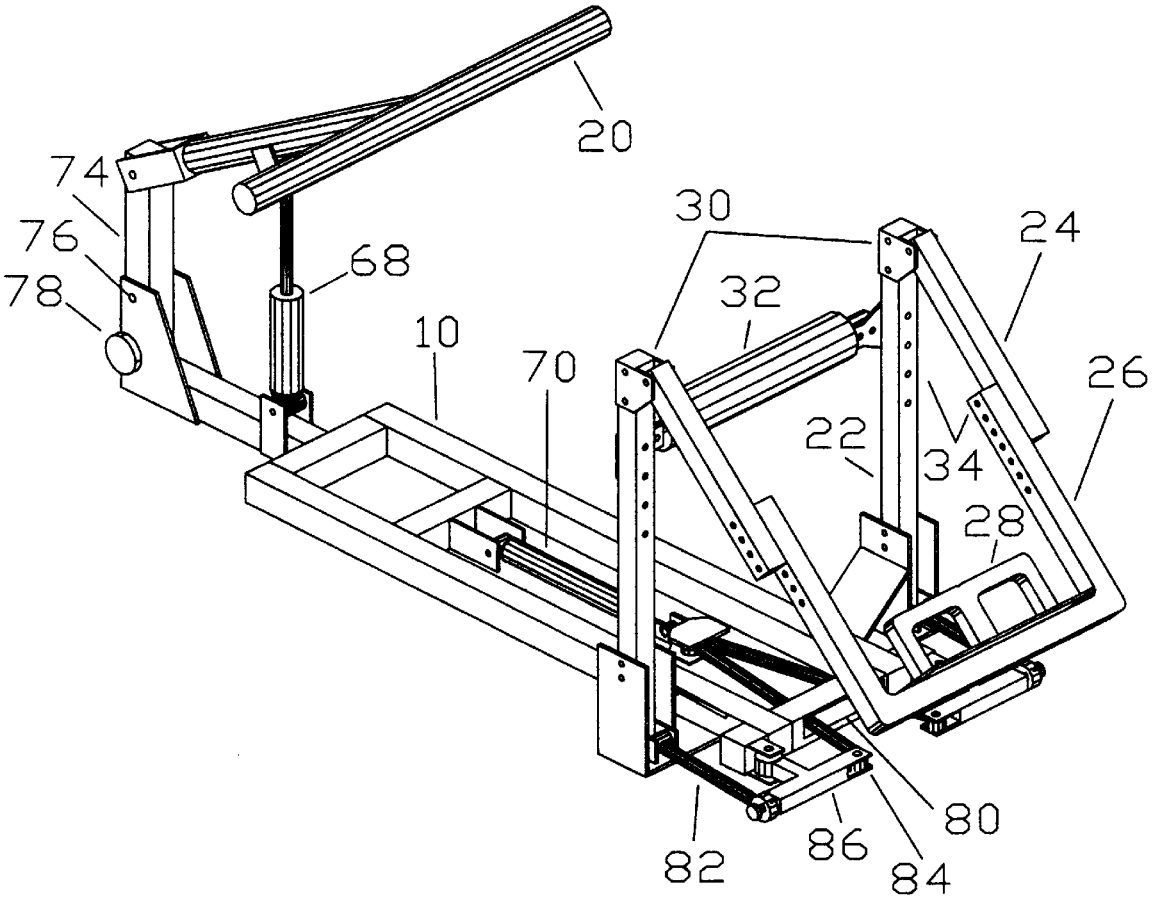

FIG. 9: This version is similar to that of FIG. 8 except for having a different linkage for transferring force to the leg press mechanism.

Figure 10:
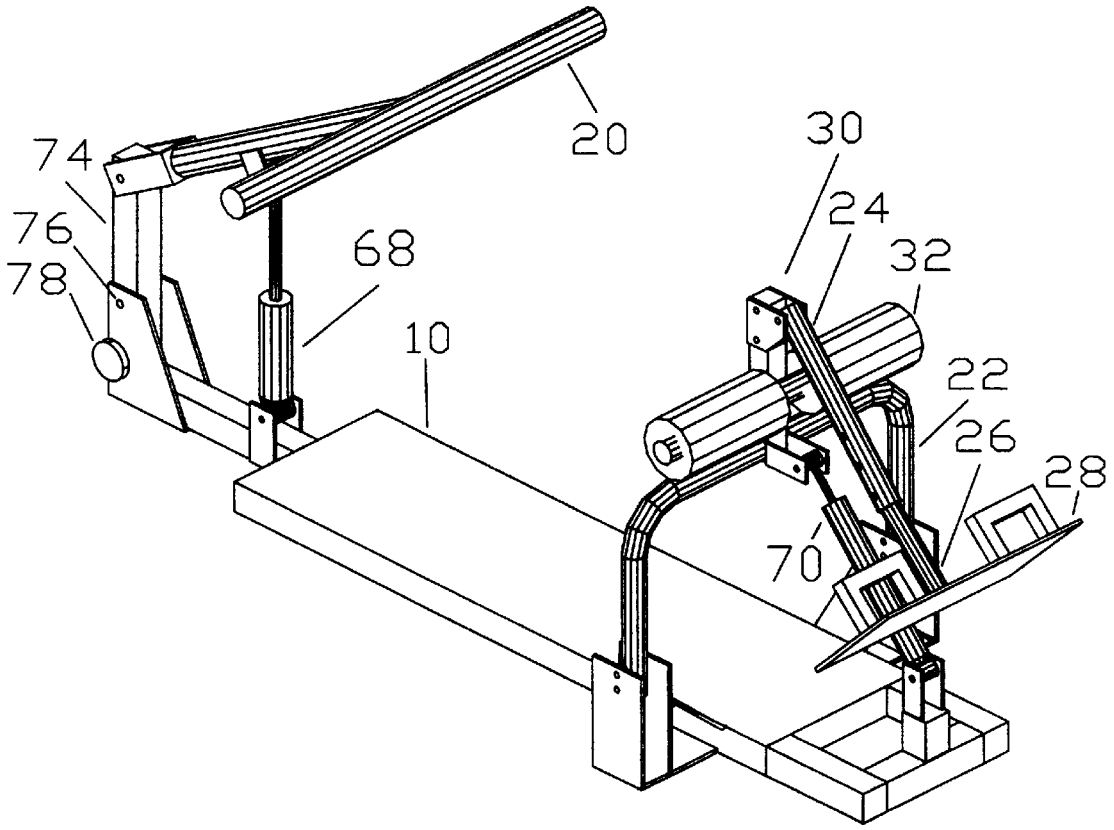

FIG. 10: This version is similar to the previous two except that there is still different method of transferring force to the leg press mechanism in this design.

Reference Numerals In Drawings

10. bench
12. left upper body damper
14. right upper body damper
16. left leg damper
18. right leg damper
20. push/pull bar
22. upper leg press bar
24. lower leg press bar
26. foot rest bar
28. foot rest
30. leg press hinge
32. thigh pull bar(padded)
34. boltholes
36. hydraulic lines
38. computer
40. computer wiring harness
42. upper body dampers hydraulic circuit flow direction sensor
44. leg dampers hydraulic circuit flow direction sensor
46. upper body dampers hydraulic circuit flow rate sensor
48. leg dampers hydraulic circuit flow rate sensor
50. upper body dampers hydraulic circuit pressure sensor
52. leg dampers hydraulic circuit pressure sensor
54. upper body dampers hydraulic circuit solenoid valve
56. leg dampers hydraulic circuit solenoid valve
58. upper body damper resistance control valves
60. leg damper resistance control valves
62. damper adjusting valve
64. air damper resistance control valves
66. damper resistance adjusting dial
68. upper body damper
70. leg damper
72. leg force transfer linkage
74. collapsible upright
76. collapsible upright hinge pin
78. collapsible upright lock knob
80. force transfer linkage slot
82. outer pushrod
84. inner pushrod
86. leg force transfer lever

DESCRIPTION

FIGS. 1 to 7

The most typical and basic models of the exercise machine in FIGS. 1 through 7 are illustrated in FIGS. 1 and 2 and all of these versions use most of the same parts. On these models the user would lie upon the workout bench 10 and apply force with their hands to the push/pull bar 20, with their feet to the foot rest 28, and with the front part of their thigh to the thigh pull bar 32. Resistance will be supplied to the push/pull bar 20 via left and right upper body dampers 12, 14 which are mounted at their bases to the bench 10. The upper body dampers 12, 14 can pivot about their mounting points on the bench 10. Resistance is supplied to the upper leg press bar 22 via left and right leg dampers 16, 18 which are mounted at their bases to the bench 10. The thigh pull bar 32 is mounted atop the upper leg press bar 22 and it allows the user to apply force to it in order to pull the upper leg press bar 22 inward as it pivots about its mounting position on the bench 10. At each top end of the upper leg press bar 22 we have a leg press hinge 30 which joins the lower leg press bar 24 to the upper leg press bar 22 allowing movement at the hinge 30. Mounted at the second ends of the lower leg press bar 24 is the foot rest bar 26 and mounted to it is the foot rest 28. As you can see there is a multitude of bolt holes 34 which are there so that adjustments can be made to the exercise machine components in order to accommodate the size of the user.

Five models which are based on the machine illustrated in FIG. 2 can be seen illustrated in FIGS. 3 to 7.

In FIG. 3 and FIG. 3A we see an exercise machine based on the previous exercise machines discussed herein although it differs in operation in that the force exerted in the upper body and leg dampers 12, 14, 16, 18 is controlled through the use of a computer controlled hydraulic circuit. The major changes applied to this model include: a computer 38 which monitors fluid variables in the dampers 12, 14, 16, 18 and adjusts upper body and leg damper solenoid valves 54, 56 via the computer wiring harness 40, in order to maintain a customized workout. It also has separate flow direction sensors 42, 44, flow rate sensors 46, 48 and pressure sensors 50, 52 for the upper body and leg press hydraulic circuits which provide workout information to the computer 38 via the computer wiring harness 40. It's dampers 12, 14, 16, 18 have openings on each end of their cylinders connected to hydraulic lines 36 which go through the sensors 42, 44, 46, 48, 50, 52 and solenoid valves 54, 56. All of these parts work together to maintain either a desired workout speed or load level via computer controls.

The model in FIG. 4 is also based on the basic model of FIG. 2 but utilizes a manually adjustable hydraulic resistance system. This model is similar to the computerized model shown in FIG. 3 because the dampers 12, 14, 16, 18 are the same and they are hooked up to a hydraulic circuit. The only difference is that the hydraulic lines 36 run through manually adjusted damper resistance control valves 58, 60. There is one control valve for the upper body dampers 58 and one for leg dampers 60. Each valve has two adjusting screws and as the fluid flow direction changes, flow is channeled through a respective adjusting screw automatically via ball and spring passages. This allows the user to adjust the load for pushing and pulling separately as they will probably be able push a higher load than they could pull due to the physiology of the human body.

The machine in FIG. 5 is very similar to the model in FIG. 4, the only difference is that instead of having one control valve for the upper body dampers and one for the leg dampers, the dampers in this model each have their own damper adjusting valve 62. Because all four dampers can be adjusted separately the adjusting screws will have to have indexing marks and numbers so that uniform damper loads can be maintained.

The model in FIG. 6 is very similar to the previous models, the main difference is that air is the working fluid in the dampers. On top of each of these dampers is a pair of needle valves called the air damper resistance control valves 64, which are merely needle valves. Each of these are turned in or out to set the damper resistance and a ball and spring mechanism in each valve allows air to flow through only one valve depending on the direction of flow. This allows for separate adjustment of the push and pull loads. These adjustment screws must also be indexed and numbered so that loads can be applied uniformly on both sides of the machine.

The machine in FIG. 7 is also similar to the previous models, the main difference being that the resistance is controlled via dial adjustable resistance dampers. On the top of each of these dampers is a damper resistance adjusting dial 66. These dials are turned either clockwise or counterclockwise to increase or decrease the resistance in the dampers.

FIGS. 8 through 10 depict versions that only require two dampers in order to provide resistance as compared to the four needed in the previous seven models. Other than this difference, the method of use is the same as for the previous seven versions. Please note that although it is not shown in the following models, these models can be used with all of the previously shown dampers to provide workout resistance.

In FIG. 8. The push/pull bar 20 is now attached to a beam which extends to and is hinged to the collapsible upright 74. The collapsible upright 74 is hinged to the bench 10 by the collapsible upright pin 76. The collapsible upright is kept from rotating by the collapsible upright lock knob 78 which can be removed in order to fold down the push/pull bar 20. The single upper body damper 68 mounts at its lower end to the bench 10 and at its upper end to the push/pull bar 20. The location where force is exerted on the upper leg press bar 22 is the same as in FIGS. 2 through 7, the only differences is that from this point the force is transferred to the leg force transfer linkage 72. Said linkage slides inside of the force transfer linkage slot 80 and is then attached on its other side to the leg damper 70 which is in turn mounted on its other end to the bench 10.

The model depicted in FIG. 9 has the same mechanism for use in the upper body workout but it varies from the previous model in the mechanism used for transferring force to the lower body workout mechanisms. In this design the force is transferred to the upper leg press bar 22 on the opposite side of where it was applied in the previous model. From here it is transferred to the outer pushrod 82 which then applies force to the leg force transfer lever 86 which is hinged to the bench 10, the force is then applied to the inner pushrod 84 which extends through the transfer linkage slot 80 and is attached to the leg damper 70 on its other end. The leg damper 70 is then mounted to the bench 10 on its other end.

The model depicted in FIG. 10 utilizes the same mechanism for the upper body workout but its lower body workout mechanism differs from those shown in the previous models. In this model there is only one leg press hinge 30 which is mounted on the top end of the upper leg press bar 22 and is in turn hinged to the lower leg press bar 24 which is then bolted to the footrest bar 26 which is attached at its other end to the footrest 28. In this design the thigh pull bar(padded) 32 is mounted through its center to the upper leg press bar 22. Force is applied to the upper leg press bar 22 via the leg damper 70 which is mounted on its upper end to the upper leg press bar 22 and on its lower end to the bench 10.

OPERATION

FIGS. 1–10

The process of using the exercise machine is as follows. The user will lie back down on the bench platform 10, placing their thighs in front of the footrest side of the thigh pull bar 32 and locating their shoulders just inside of the left and right upper body workout dampers 12, 14. (Note: On the models depicted in FIGS. 8–10 the user would position their chest underneath the push/pull bar 20 as there are no dampers on the sides from which to index ones shoulders upon.) The user will then place their feet on the foot rest 28 provided by the leg exercise mechanism, with their upper thighs pressing against the thigh pull bar 32. The user will then grab the outer ends of the push/pull bar 20. The user is now in the correct position for exercise.

Prototype testing has shown the following routine to be the most ergonomically correct for this exercise machine. The user should push the push/pull bar 20 up as he/she is pulling the thigh pull bar 32 in towards their chest by applying force to the thigh pull bar 32 with their upper thighs and using abdominal muscles. When the dampers 12, 14, 16, 18 (68, 70 in FIGS. 8–10) have fully compressed or extended, as the case may be, the user then needs to pull down on the push/pull bar 20 and push out on the foot rest 28 until fill compression/extension has occurred in the respective dampers 12, 14, 16, 18 (68, 70 in FIGS. 8–10). This procedure completes one full cycle of motion so the user can then follow through with this procedure for however many repetitions he/she desires. From this routine, one should observe the benefits of this design, in that it allows for exercises in a multitude of body muscles in one routine and this feature is greatly complimented by the push/pull resistance characteristics of the dampers 12, 14, 16, 18 (68, 70 in FIGS. 8–10).

In the adjustable damper model of this exercise machine the user will manually set the desired workout resistance and then begin the aforementioned exercise routine.

In the computerized resistance and speed controlled version the user can either set a desired workout resistance which will be maintained at all times or he/she may set a desired workout speed which will be maintained. In order to maintain a specified workout resistance the computer will use sensor data to determine how to control the solenoid valve in order to keep a constant damper force. The method by which the workout speed is controlled is that the computer 38 will either increase the resistance in the dampers 12, 14, 16, 18 if the workout speed is going too fast or decrease the resistance if the workout speed is too slow. With this function the user can create a workout that will flow with a specified tempo. This feature is very usefil in creating a high speed aerobic workout. With the computerized version the user can also see how many calories were burned, the number of repetitions, the workout tempo and the average workout power at the press of a button. Other than these features, the exercise routine is the same as in the aforementioned versions.

SUMMARY, RAMIFICATIONS, AND SCOPE

The novel features of this invention consists of the basic design of the exercise machine, the fact that it offers a single workout routine which exercises all the major muscle groups simultaneously, the push/pull resistance which it offers, the adjustable damper resistance which it offers, the customized computer monitored and controlled workout, it's simplicity of design and manufacture and the fact that it is compact and easy to store away even with limited space.

Although the description of the above contains many specificity's, these should not be construed as limiting the scope of the invention but merely as providing illustrations of some of the presently preferred embodiments of this invention. Some possible ramifications for this invention consist of the following. The method of providing damper resistance could consist of either adjustable or non-adjustable dampers and the mechanism of damping could be either hydraulic, pneumatic, spring loaded, elastomer loaded, electromagnetic or magnetohydrodynamic utilizing a variety of fluids or gasses and the dampers may exist in a combination of any of these features. Other methods for providing resistance may be applied for use in future models.

Another ramification that exists for this invention is that several degrees of freedom of motion are designed into the leg and/or push/pull bar mechanisms and force resistance may be applied to these degrees of freedom of motion for a more extreme workout.

Still another ramification that exists is that the basic frame and mechanism designs of the invention may be altered in order to reduce costs, increase the ease of manufacture and/or make the machine more ergonomically correct.

One other ramification that exists is for the provision of a padded head rest and shoulder chocks that would be placed on the padded bench so that the user would not slide back as much when pushing out on the foot rest.

A further ramification would provide for a means of applying the resistive force at different points along rotating mechanisms so as to vary the moments and therefore the force that is applied to the user.

Thus the scope of the invention should be determined by the appended claims and their legal equivalents, rather than by the examples given.

I claim:

1. An exercise machine to train the majority of the muscles of the human body simultaneously, comprising a frame, a lever hingeably connected by its first end to the first end of said frame, a handle bar mounted by its midpoint to the second end of said lever, a means of resistance connected at its first end to said frame and connected at its second end to said lever, a U-shaped lever hingeably connected by its first end to a point along the side of and near the second end of said frame and hingeably connected by its second end to a similar location along the opposite side of said frame, a second means of resistance connected at its first end to said frame and connected by its second end to said U-shaped lever, a post mounted at its first end to the midpoint of said U-shaped lever, a tube hingeably connected by its first end to the second end of said post, a bar inserted at its first end into said tube, a means of locking said tube and said bar together to vary the length at which said bar extends out of said tube, a plate mounted by the center of its top surface to the second end of said bar and two adjustable straps mounted to the top surface of said plate, each one located to opposite sides of said bar.

2. The exercise machine of claim 1 wherein the first end of said lever is hingeably connected to the first end of an upright, said upright is hingeably connected by its second end to the first end of said frame, said upright possessing a means whereby it can either be locked in a vertical position or folded into a more horizontal position relative to said frame.

3. The exercise machine of claim 2 wherein said U-shaped lever, said tube and said bar are replaced by two beams hingeably connected by a point near their first ends to points on opposite sides of and near the second end of said frame, a linkage connecting the first ends of said beams to the second end of said second means of resistance, a padded bar mounted at its first end to a point near the second end of one of said beams and mounted by its second end to a similar point on the other of said beams, said beams possessing a means for which the mounting position of said padded bar can be varied, two columns hingeably connected by their first ends to a point near the second ends of said beams, said beams possessing a means for varying the hinged connecting point of said columns, a U-shaped bar mounted at its first end to a point near the second end of one of said columns and mounted at its second end to a similar point on the other of said columns, said columns and U-shaped bar possessing a means of varying the location at which they are mounted together, a plate mounted to the center of said U-shaped bar and two adjustable straps mounted to the top surface of said plate.

4. The exercise machine of claim 2 wherein resistance is supplied by adjustable hydraulic dampers.

5. The exercise machine of claim 2 wherein resistance is supplied by non-adjustable hydraulic dampers.

6. The exercise machine of claim 2 wherein resistance is supplied by adjustable pneumatic dampers.

7. The exercise machine of claim 2 wherein resistance is supplied by non-adjustable pneumatic dampers.

8. The exercise machine of claim 2 wherein the resistance of force dampers is monitored and adjusted via solenoid valves in tubing lines, which are connected to said force dampers, possessing a computer which uses data received from flow direction, flow rate and pressure sensors, in order to create control signals to control said solenoid valves.

9. The exercise machine of claim 2 wherein force damper resistance is manually adjustable via adjustment valves which are mounted in tubing lines which are attached to said force dampers.

10. The exercise machine of claim 2, wherein pneumatic damper resistance is adjustable via air bleed adjustment valves.

11. The exercise machine of claim 2 wherein resistance is provided by force dampers for which a moving dial mounted on said force dampers is used to adjust the resistance.

12. The exercise machine of claim 2 wherein the resistance is provided by electromagnetic actuators.

13. The exercise machine of claim 2 wherein the resistance is provided by magnetohydraulic dampers.

14. The exercise machine of claim 3 wherein resistance is supplied by adjustable hydraulic dampers.

15. The exercise machine of claim 3 wherein resistance is supplied by non-adjustable hydraulic dampers.

16. The exercise machine of claim 3 wherein resistance is supplied by adjustable pneumatic dampers.

17. The exercise machine of claim 3 wherein resistance is supplied by non-adjustable pneumatic dampers.

18. The exercise machine of claim 3 wherein the resistance of force dampers is monitored and adjusted via solenoid valves in tubing lines, which are connected to said force dampers, possessing a computer which uses data received from flow direction, flow rate and pressure sensors, in order to create control signals to control said solenoid valves.

19. The exercise machine of claim 3 wherein force damper resistance is manually adjustable via adjustment valves which are mounted in tubing lines which are attached to said force dampers.

20. The exercise machine of claim 3, wherein pneumatic damper resistance is adjustable via air bleed adjustment valves.

21. The exercise machine of claim 3 wherein resistance is provided by force dampers for which a moving dial mounted on said force dampers is used to adjust the resistance.

22. The exercise machine of claim 3 wherein the resistance is provided by electromagnetic actuators.

23. The exercise machine of claim 3 wherein the resistance is provided by magnetohydraulic dampers.

* * * * *